United States Patent [19]

Imboden et al.

[11] 4,021,861

[45] May 10, 1977

[54] PANTYHOSE CONSTRUCTION

[75] Inventors: Walter H. Imboden; Aaron Burleson, both of Burlington, N.C.

[73] Assignee: Burlington Industries, Inc., Greensboro, N.C.

[22] Filed: Jan. 28, 1975

[21] Appl. No.: 544,680

[52] U.S. Cl. ..... 2/409
[51] Int. Cl.[2] ..... A41B 9/04
[58] Field of Search ..... 2/224 R, 240, 224 A, 2/409; 66/177, 176, 178 A

[56] References Cited

UNITED STATES PATENTS

| | | | |
|---|---|---|---|
| 3,487,473 | 1/1970 | Janhsen | 2/224 R X |
| 3,673,821 | 7/1972 | Johnson | 2/224 R X |
| 3,678,514 | 7/1972 | Safeit | 2/224 R X |

FOREIGN PATENTS OR APPLICATIONS

| | | | |
|---|---|---|---|
| 1,800,166 | 10/1968 | Germany | 66/177 |

*Primary Examiner*—H. Hampton Hunter

*Attorney, Agent, or Firm*—Cushman, Darby & Cushman

[57] ABSTRACT

An improved seamless crotch pantyhose garment includes an integrally knitted, continuous tubular blank having a pair of seamless tubular leg portions and a body portion which is knit integral with and interconnects the leg portions, thereby defining a seamless crotch area. The body portion is slit walewise to define a body receiving opening opposite to the seamless crotch. A decorative lace-like material which is substantially wider than the normal or even widest elastic support known and of substantially greater strength than the tubular blank is sewn onto the body portion of the blank about the slit to thereby define a panty portion of pantyhose which material provides the additional depth required to provide a satisfactory reach or rise from the crotch to the waistband necessary for a well fitted undergarment. In addition, the lace-like material, while enhancing the aesthetic appearance of the pantyhose, also, substantially strengthens the pantyhose against tears, snags or the propagation of runs to thereby increase the longevity of the undergarment.

4 Claims, 3 Drawing Figures

PANTYHOSE CONSTRUCTION

BACKGROUND OF THE INVENTION

This invention relates to a seamless crotch, knitted pantyhose garment, and more specifically relate to a seamless crotch panyhose having a tear and run resistant material sewn onto the body portion thereof to provide the rise necessary from crotch to waistband to provide a well-fitted undergarment. .

Garments have been made in the past providing a panyhose which combines stocking portions with a body or panty portion to form an integral pantyhose structure which would not require the use of garter belts or hosiery support attachments which often resulted in snags or runs developing in the stockings. For example, Riche U.S. Pat. No. Re. 25,360 discloses a combination stocking and pantyhose structure which overcame the previous problem of utilizing separate garter belts or hosiery support attachments. Rice formed a pantyhose garment by forming two separate stockings with nylon yarn with an elongated welt formed at the top thereof. Upon completing the formation of the stockings, a U-shaped slit was formed in one stocking to mate with a U-shaped slit in the other stocking. These slits were joined together to form a continuous U-shaped seam which extends from the front of the pantyhose at the top thereof downwardly to bisect the crotch area and then upward again to the rear of the pantyhose section.

Later, Ferrell disclosed in U.S. Pat. No. 3,675,247 a method of fabricating a pantyhose of the type designed by Riche wherein the steps of cutting a slit in the stockings and then sewing the two stockings together along the sides of the slits to form the combination panty-stocking garment was eliminated. However, the Ferrell method still resulted in a pantyhose stocking which had a seam extending through the crotch portion in the same manner as the Rice stocking. As is well known, seams are a particular problem in the crotch area of pantyhose where seams of the typical U-seam type or crotch panel type can cause the crotch to fit improperly or the seam of the U-seam or crotch piece can cause irritation in the sensitive crotch area. Accordingly, efforts were developed to provide a seamless pantyhose. Thus, Johnson disclosed in U.S. Pat. No. 3,673,821 a pantyhose structure formed of a single tubular blank having a pair of leg portions and an intermediate body portion. The body portion was slit longitudinally and an elastic band ¼ to 2 inches wide was secured thereto by a sewing step so that the pantyhose could be secured to the trunk portion of the body. This single piece seamless pantyhose, while being an improvement over the prior art in that it had no seams in the sensitive crotch area, had a substantial drawback which has proved difficult and has not been overcome by efficient mass production techniques. Thus, because the pantyhose was formed from a single tube of nylon, the trunk or panty portion thereof did not provide adequate rise to the waistline. Thus, not enough material was knitted to provide a body portion of the pantyhose extending from the crotch to the waistline to give the proper fit required for comfortably and securely attaching the pantyhose to the legs and body of the person wearing the pantyhose. Substantial effort has been made to overcome this problem as exemplified by inventions disclosed in the following patents: Fregeolle U.S. Pat. No. 3,802,229, German Pat. No. 1,800,166 and German Pat. No. 1,938,623. However, each of these patents discloses a rather complex knitting arrangement wherein combinations of rotary knitted and reciprocally knitted pantyhose portions are formed. In order to provide such pantyhose, special equipment is required, and extra time is required for the substitution of reciprocating for rotary courses. Even thus, the problem is not solved. In addition, as is well known in the art, reciprocally knitted hosiery is subject to runs since reciprocal knitting cannot provide a variety of stitch constructions such as tuck stitches required for rendering the garment run-proof in at least one direction.

A further drawback to the seamless pantyhose construction of the Johnson type is that the sheer nylon typically forming the pantyhose does not have adequate strength to sustain the gripping and pulling in the body portion thereof when the pantyhose is pulled over the legs and the trunk portion of the person wearing the pantyhose. This is because of the necessarily loose knitting required to provide the maximum rise possible. Thus, snags due to loose knitting, tears, runs, etc., are easily developed in these pantyhose even when the person wearing the pantyhose exercises unusual care in pulling the pantyhose on.

In view of the aforementioned, it is an object of this invention to provide a seamless crotch pantyhose having sufficient rise to fit comfortably around the waistline of a person wearing the pantyhose.

It is another object of the invention to provide an improved pantyhose construction having a strengthened upper panty portion so that runs, tears, etc., are not developed when the pantyhose is pulled onto the person wearing the pantyhose.

It is yet another object of this invention to provide an improved pantyhose structure having a seamless crotch which is substantially run-proof in the area joining the sheer nylon portion of the pantyhose with the upper panty portion thereof.

It is yet another object of the present invention to provide an improved pantyhose structure having a seamless crotch and which is capable of variations in designs in the panty portion therefore to accommodate fashion changes.

SHORT STATEMENT OF THE INVENTION

Accordingly, an improved seamless crotch pantyhose garment has been developed which includes an integrally knitted, continuous tubular blank having a pair of seamless tubular leg portions and a tubular body portion which is knit integral with, is run proof in one direction, and interconnects the leg portions to thereby define a seamless crotch area. The body portion opposite the seamless crotch is slit walewise to define a body receiving opening to which is sewn a relatively strong and wide lace-like material about the perimeter of the slit, the lace-like material and the body portion of the tubular blank defining a strengthened panty portion of the pantyhose which extends upwardly about the waist of a person wearing the pantyhose.

At the non-runproof end, described hereinafter, of the slit portion of the integrally knitted tubular blank is formed a binding which substantially eliminates the possibility of a run being propagated along the leg portion of the pantyhose from the point at which the strengthened lace-like material is sewn onto the seamless tubular body portion of the pantyhose.

BRIEF DESCRIPTION OF THE DRAWING

Other objects, features and advantages of the invention will become more fully apparent from the following detailed description of the preferred embodiment, the appended claims and the accompanying drawings in which:

DETAILED DESCRIPTION OF THE PREFERRED EMBODIMENT

Figure 3:
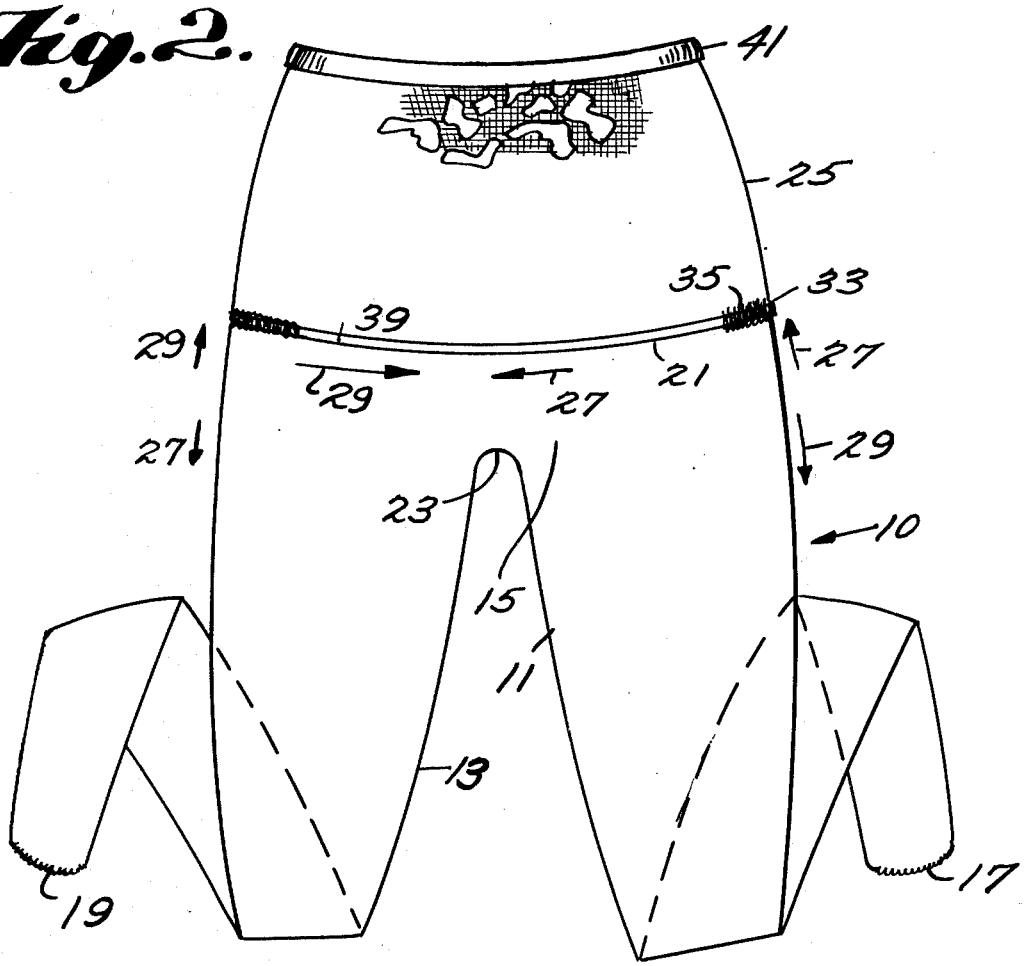
FIG. 3 is an illustration of the seamless crotch pantyhose construction of the present invention including a strengthened lace-like material secured to the upper body portion thereof.

Refer now to FIG. 3 which illustrates the pantyhose construction of the preferred embodiment. As illustrated, the pantyhose includes a tubular blank of sheet nylon 10 which preferably is formed by rotational knitting in a circular knitting machine. However, it should be understood that the blank can be formed by reciprocal knitting or other known methods. The tubular blank forms a pair of seamless tubular leg portions 11 and 13 joined together integrally by means of a seamless crotch body portion 15. In the preferred embodiment the body portion 15 is formed by the same rotary knitting process as is the leg portions 11 and 13. It is preferred to have a runproof mesh in the panty or body portion 15, while the legs can be plain knit or mesh. At the bottom of each of the leg portions 11 and 13 are formed toe portions 17 and 19, respectively. The toe portions may be closed in a knitting process as disclosed, for example, in Currier U.S. Pat. No. 26,581 or may be simply open toe portions which are subsequently closed by a conventional sewing operation.

A slit 21 is formed on the opposite side of the body portion 15 of the tubular blank from the crotch 23 thereof. The slit is made walewise to provide the necessary opening for receiving the legs and trunk of the person wearing the pantyhose.

As can be seen from FIG. 3, the tubular blank portion of the pantyhose does not have sufficient rise for the slit 21 to reach up as far as the waist of the person wearing the pantyhose. The reason for this is that the small diameter of the knitting machine, e.g., on the order of four inches, prevents forming enough fabric to provide a satisfactory rise in the body or panty portion 15. The diameter of the knitting machine, as is well known, must be small in order to limit the size of the leg portions of the pantyhose. In order to give the pantyhose sufficient rise so that it can reach the waist, a strengthened and preferably attractively fashioned material 25 of considerable width is attached to the sheer nylon portion of the pantyhose about the slit 21 by a special knifeless sewing process. The material 25 not only provides additional rise in the trunk portion of the pantyhose so that the pantyhose can extend up to and about the waistline of the person wearing the pantyhose, but also provides a strengthened upper panty portion of the pantyhose so that when it is gripped to pull it over the legs of the person wearing the pantyhose, it does not easily rip, tear or cause runs to be propagated the length of the pantyhose.

Figure 1:
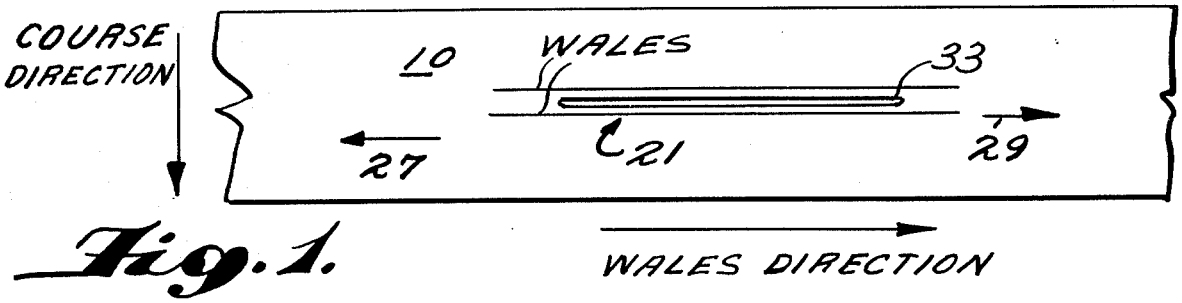
FIG. 1 illustrates a collapsed view of the slit opening of an integrally knitted, continuous tubular blank having the slit formed in the same wale of the blank.

Refer now briefly to FIG. 1 which is a simplified illustration, not to scale, of the blank 10 having a slit 21 formed preferably in a single wale of the blank. As shown by the arrows, the wales extend along the longitudinal length of the blank, while the courses extend substantially perpendicular thereto. It is important that as few wales as possible are cut in order to limit the potential for run propoagation along and from the slit wales. During the subsequent process of sewing the decorative lace fabric 25 to the blank, the knit fabric 10 is not cut away as the decorative lace fabric is sewn together with the knitted blank 10. This is in contrast to known prior art hosiery seaming processes where a knife is mounted slightly ahead of the needle to cut the fabric immediately before sewing. If the knitted fabric 10 were cut during the sewing process, extra wales would be cut or severed, thereby introducing additional weakened areas from which runs can propagate. It therefore is preferable that a knifeless seaming process be utilized in order not to sever or disturb any extra wales along the blank.

In the preferred embodiment of the invention, a widened non-pantyhose fabric, preferably a decorative lace, is utilized to thereby provide not only a strengthened portion of the pantyhose, but also to provide a highly attractive and decorative rise portion of the panty portion of the pantyhose structure. It has been found by applicants that in using a preferred decorative lace-like material for the rise portion of the pantyhose, the decorative fabric has approximately three times the strength of sheer nylon when stretched in the vertical direction which is the direction stressed when pulling the garment on. In addition, the lace material has aproximately 1.3 times the strength of sheer nylon when stretched in the horizontal or circumferential direction; although it should be understood that these values can be varied by varying the design and type of decorative fabric utilized. Accordingly, in addition to enchancing the aesthetic appearance of the pantyhose, the lace-like material also substantially strengthens the pantyhose against tears, snags or the propagation of runs to thereby increase the longevity and wear of the pantyhose garment. An elastic band 41, of any suitable width, such as disclosed at numeral 170 in the aforementioned Johnson patent is sewn onto the material 25 to secure the pantyhose about the waist of the wearer.

As is known in the art, a mesh fabric which could be used in either the body portion of the blank or the leg portions of the pantyhose will be completely runproof in the direction from the first knit loops towards the last knit loops if each wale either contains or is adjacent to a tuck stitch. It is also well known that there is no run inhibition in the opposite direction. Accordingly, in a double leg blank, such as illustrated in FIG. 3, the fabric becomes runproof wherever mesh stitches are used in the direction from the first knit toe 17 towards the last knit toe 19 and is not runproof in the opposite direction. When, and if, jersey (plain) knitting is used, there is no run inhibition in either direction. Thus in the double leg blank 10 illustrated, assuming the garment is entirely mesh, the sheer nylon is runproof in the direction illustrated by the arrow 27, while there is no run inhibition in the direction of the arrow 29. It therefore is preferable that runs from the slit line 21 in the body portion 15 where the lace-like material of the finished garment is attached to the double leg blank be prevented. This is of particular importance where a material is secured to the sheer fabric by a seaming operation wherein the finished seam at 21 is bordered on one side, i.e., the sheer nylon blank side, by relatively weak stitches. In addition, the prevention of run propagation is of most critical importance at the end 33 of the slit 21 since this is the weakest point of the nylon tubular blank 10.

Figure 2:
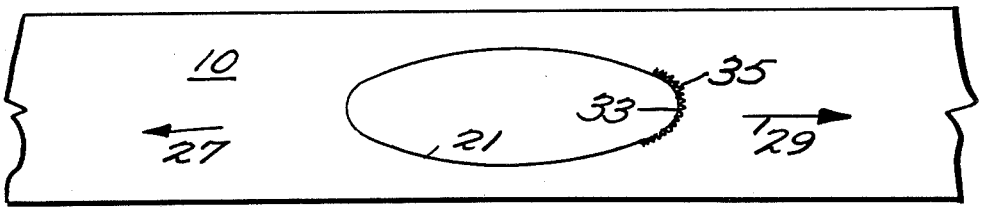
FIG. 2 is an illustration of an integrally knitted, continuous tubular blank having the slit opened with a binding around one edge thereof to prevent runs from propagating along the tubular blank.

Accordingly, with reference to FIG. 2 which illustrates the slit after it is stretched open, an arc of reinforcing overedge seam stitches is formed around the first knit end 33 of the slit line 21, as illustrated by the numeral 35. The overedge stitching process involves the gathering into the reinforced overedge area of several stitches outward from the slit line itself. Since the slit line as produced by the knitting equipment affects only one wale, and if performed manually desirably affects a minimum of wales, the inclusion into this reinforcement of several additional wales is a method of strengthening the weakened end 33 of the slit 21 against runs. Thus, not only does the overedge seam 35 result in strengthening of an inherently weak area 33 at the termination of the slit line to thereby discourage runs from emanating therefrom toward the first knit toe 17 of the double leg blank, but also takes in sufficient wales outward from the slit line to prevent any runs which may develop at any point of weakness along the slit line 21 or the seam 39 in the finished garment from progressing beyond this reinforcement and down the first knit leg toward the first knit toe 17. The runproof characteristic of mesh stitches in the panty prevents runs in the opposite direction. In addition, such an overedge seam does not aesthetically detract from the appearance of the garment since the overedge seam will be substantially unnoticed when the decorous lace-like garment 25 is secured to the trunk portion of the double leg blank 10. In the event the garment is produced without mesh in the central area, the reinforcement would obviously be desirable at both ends of the slit line. It will also be remembered that the knifeless seaming process provides added protection against the formation and propagation of runs in the pantyhose since such a process does not sever additional wales in the stocking.

While the aforegoing invention has been disclosed in connection with the preferred embodiment, it should be understood that other obvious variants of the invention as disclosed can be made which fall within the spirit and scope of the appended claims. Thus, for example, while a sheer nylon tubular blank is disclosed which is formed by a rotary knitting process, it should be understood that materials other than nylon may be utilized and of course, if desired, knitting other than by the conventional rotary process may be utilized such as, for example, reciprocatory knitting. In addition, it should be understood that while a decorous lace-like material is illustrated for the rise portion of the pantyhose, other materials, such as, for example, reinforced nylon may be utilized in lieu of a decorative lace structure. Further, it should be understood that while an elastic waistband 41 is illustrated, a decorative floral lace elastic material could be utilized at 41.

What is claimed is:

1. An improved seamless crotch pantyhose garment comprising:

an integrally knitted, continuous tubular blank having a pair of seamless tubular leg portions and a tubular body portion knit integral with and interconnecting said leg portions, said body portion defining a seamless crotch area and said body portion being slit walewise opposite said crotch area to define a body receiving opening, an over-edge seam stitched around the first knit end of said slit line, said over-edge seam gathering in a plurality of wales about a portion of said slit to thereby strengthen the portion of the slit perimeter covered by said over-edge seam, and said over-edge seam inhibiting the propagation of runs along the non-runproof direction of said tubular blank, and a rise portion sewn onto said portion about said slit to define with said body portion a panty portion extending upward to and about the waist.

2. The improved seamless crotch pantyhose garment of claim 1 wherein said rise portion includes a lace-like material having a strength which is substantially greater than the strength of the integrally knitted tubular blank portion of said pantyhose.

3. The improved seamless crotch pantyhose garment of claim 1 wherein said integrally knitted continuous tubular blank comprises sheer nylon.

4. An improved seamless crotch pantyhose garment comprising: an integrally knitted, continuous tubular blank having a pair of seamless tubular leg portions and a tubular body portion interconnecting said leg portions, said body portion being slit walewise opposite said seamless crotch area to define a body receiving opening, and a relatively strong material sewn onto said body portion about said slit to define with said body portion a panty portion of said pantyhose, said material extending upwardly to provide a substantially increased crotch to waist rise.

* * * * *